US012628942B2

(12) United States Patent
Lee et al.

(10) Patent No.: US 12,628,942 B2
(45) Date of Patent: May 19, 2026

(54) CHANNEL ASSEMBLY TO REDUCE WORKSURFACE SAG

(71) Applicant: Knoll, Inc., Zeeland, MI (US)

(72) Inventors: Jeffrey P. Lee, Mertztown, PA (US); Gary Bockol, Wynnewood, PA (US)

(73) Assignee: Knoll, Inc., Zeeland, MI (US)

( * ) Notice: Subject to any disclaimer, the term of this patent is extended or adjusted under 35 U.S.C. 154(b) by 0 days.

(21) Appl. No.: 18/437,092

(22) Filed: Feb. 8, 2024

(65) Prior Publication Data

US 2024/0268552 A1 Aug. 15, 2024

Related U.S. Application Data

(60) Provisional application No. 63/444,637, filed on Feb. 10, 2023.

(51) Int. Cl.
*A47B 13/02* (2006.01)

(52) U.S. Cl.
CPC ..... *A47B 13/02* (2013.01)

(58) Field of Classification Search
CPC .... A47B 1/10; A47B 1/08; A47B 9/20; A47B 13/02; A47B 13/00
See application file for complete search history.

(56) References Cited

U.S. PATENT DOCUMENTS 1,270,458 A * 6/1918 Syred ..... A47B 1/02 108/85
1,609,368 A * 12/1926 Kusterer ..... A47B 1/08 108/74
3,042,468 A * 7/1962 Rudow ..... A47B 1/10 108/83
3,336,881 A 8/1967 Aiken
3,336,882 A 8/1967 Edelson
3,362,357 A * 1/1968 Hoffert ..... A47B 1/10 108/83
6,193,436 B1 * 2/2001 Ellis ..... A47B 13/021 403/333

(Continued)

FOREIGN PATENT DOCUMENTS

CN 202681014 U 1/2013
CN 218219516 U 1/2023

OTHER PUBLICATIONS

International Search Report and Written Opinion for Application No. PCT/US2024/15051 dated May 31, 2024 (7 pages).

*Primary Examiner* — Christopher Garft
(74) *Attorney, Agent, or Firm* — Michael Best & Friedrich LLP

(57) ABSTRACT

A channel assembly configured to support a worksurface includes an outer channel having a first end and a second end opposite the first end. The outer channel decreases in height from the first end to the second end. The channel assembly also includes an inner channel configured to be connected to the worksurface, the inner channel having a third end and a fourth end opposite the third end. The inner channel increases in height from the third end to the fourth end. The inner channel is at least partially received in the outer channel such that the fourth end is positioned within the outer channel and the second end overlaps the inner channel. The inner channel is movable relative to the outer channel to adjust a width between the first end and the third end.

20 Claims, 15 Drawing Sheets

(56) References Cited

U.S. PATENT DOCUMENTS

| | | | | |
|---|---|---|---|---|
| 6,295,669 | B1 * | 10/2001 | Saus | A47C 17/76 108/115 |
| 6,766,748 | B2 * | 7/2004 | Insalaco | A47B 21/06 108/50.02 |
| 7,869,858 | B2 * | 1/2011 | Calderon | A61G 13/121 5/601 |
| 8,746,155 | B2 * | 6/2014 | Haney | A47B 13/08 108/132 |
| 8,967,054 | B2 * | 3/2015 | Henriott | A47B 21/00 108/50.02 |
| 10,349,760 | B2 * | 7/2019 | Peake | A47G 1/166 |
| 10,390,611 | B2 * | 8/2019 | Lee | A47B 21/02 |
| 10,820,690 | B2 * | 11/2020 | Tao | A47B 9/12 |
| 10,932,559 | B2 * | 3/2021 | Hill | A47B 33/00 |
| 11,109,672 | B2 * | 9/2021 | Anderson | A47B 13/003 |
| 11,224,279 | B2 * | 1/2022 | Fox | A47B 31/00 |
| 11,357,320 | B2 * | 6/2022 | Jørgensen | A47B 9/20 |
| 11,383,312 | B2 * | 7/2022 | Gibson | B27B 9/04 |
| 11,779,108 | B1 * | 10/2023 | Mirth | A47B 21/06 108/50.02 |
| 11,793,304 | B2 * | 10/2023 | Benard | A47B 1/08 |
| 2010/0071599 | A1 * | 3/2010 | McEntire | A47B 13/02 108/50.11 |
| 2010/0242808 | A1 | 9/2010 | Negoro et al. | |
| 2014/0318423 | A1 * | 10/2014 | Parshad | A47B 87/002 108/60 |
| 2017/0022711 | A1 * | 1/2017 | Gilman | E04G 21/185 |
| 2018/0110325 | A1 | 4/2018 | Oberndörfer | |
| 2020/0154876 | A1 * | 5/2020 | Liu | A47B 9/00 |
| 2021/0100355 | A1 * | 4/2021 | Jørgensen | A47B 21/02 |
| 2022/0338615 | A1 * | 10/2022 | Andersson | A47B 1/08 |

* cited by examiner

CHANNEL ASSEMBLY TO REDUCE WORKSURFACE SAG

CROSS-REFERENCE TO RELATED APPLICATION

This application claims priority to U.S. Provisional Patent Application No. 63/444,637, filed Feb. 10, 2023, the entire contents of which are incorporated by reference herein.

FIELD

The present invention relates to tables and, more particularly, to a channel assembly for supporting a worksurface of a table.

SUMMARY

In one embodiment, the invention provides a channel assembly configured to support a worksurface. The channel assembly includes an outer channel having a first end and a second end opposite the first end. The outer channel decreases in height from the first end to the second end. The channel assembly also includes an inner channel configured to be connected to the worksurface. The inner channel has a third end and a fourth end opposite the third end. The inner channel increases in height from the third end to the fourth end. The inner channel is at least partially received in the outer channel such that the fourth end is positioned within the outer channel and the second end overlaps the inner channel. The inner channel is movable relative to the outer channel to adjust a width between the first end and the third end.

In another embodiment, the invention provides a table including a worksurface, a first leg coupled to the worksurface, a second leg coupled to the worksurface, and a channel assembly positioned beneath the worksurface. The channel assembly includes an outer channel having a first end coupled to the first leg and a second end opposite the first end. The outer channel decreases in height from the first end to the second end. The channel assembly also includes an inner channel connected to the worksurface. The inner channel has a third end coupled to the second leg and a fourth end opposite the third end. The inner channel increases in height from the third end to the fourth end. The inner channel is at least partially received in the outer channel such that the fourth end is positioned within the outer channel and the second end overlaps the inner channel. The inner channel is movable relative to the outer channel to adjust a width between the first end and the third end.

In yet another embodiment, the invention provides a table including a worksurface and an outer channel having a first end and a second end opposite the first end. The first end has a first height. The second end has a second height that is less than the first height. The table also includes an inner channel connected to the worksurface. The inner channel has a third end and a fourth end opposite the third end. The third end has a third height. The fourth end has a fourth height that is greater than the third height. The inner channel is at least partially received in the outer channel such that the fourth end is positioned within the outer channel and the second end overlaps the inner channel. The inner channel is movable relative to the outer channel between a first configuration and a second configuration to adjust a width between the first end and the third end. In the second configuration an upper edge of the inner channel is raised relative to an upper edge of the outer channel to push upwardly on an underside of the worksurface.

Other aspects of the invention will become apparent by consideration of the detailed description and the accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
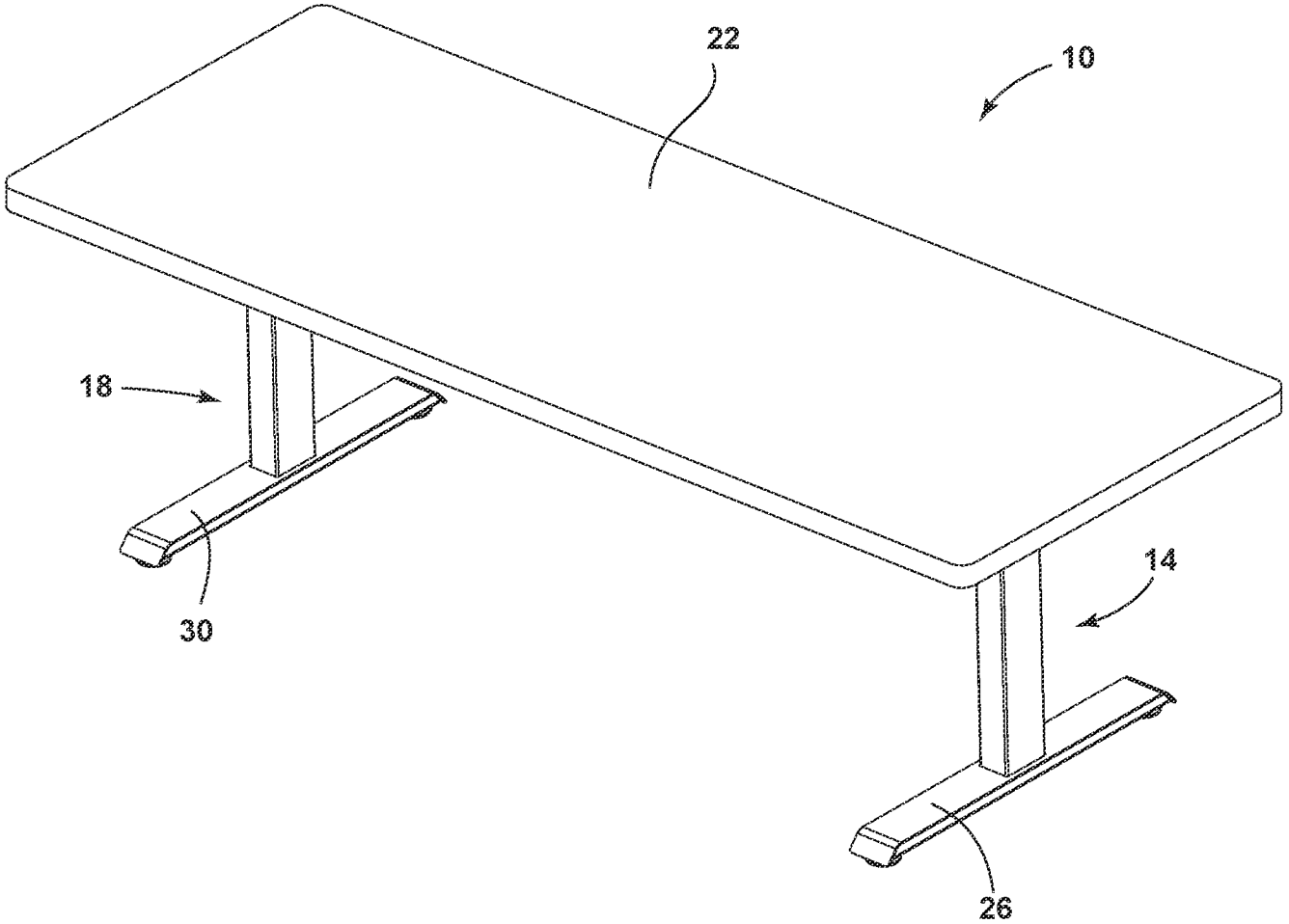
FIG. 1 is a perspective view of a table.

FIG. 1 illustrates a table 10 including a first leg 14 and a second leg 18. The table 10 further includes a worksurface 22 supported by the first leg 14 and the second leg 18. In the illustrated embodiment, the worksurface 22 is rectangular. In other embodiments, the worksurface 22 may have other shapes and/or sizes. The first leg 14 optionally includes a first foot 26 and the second leg 18 optionally includes a second foot 30. In other embodiments, the table 10 may include four or more legs, rather than two legs. In such embodiments, the legs 14, 18 may not include feet. In some embodiments, the table 10 may be a height adjustable table configured to increase or decrease the lengths of the first and second legs 14, 18 to raise or lower the worksurface 22. In other embodiments, the table 10 may be a fixed-height table.

Figure 2:
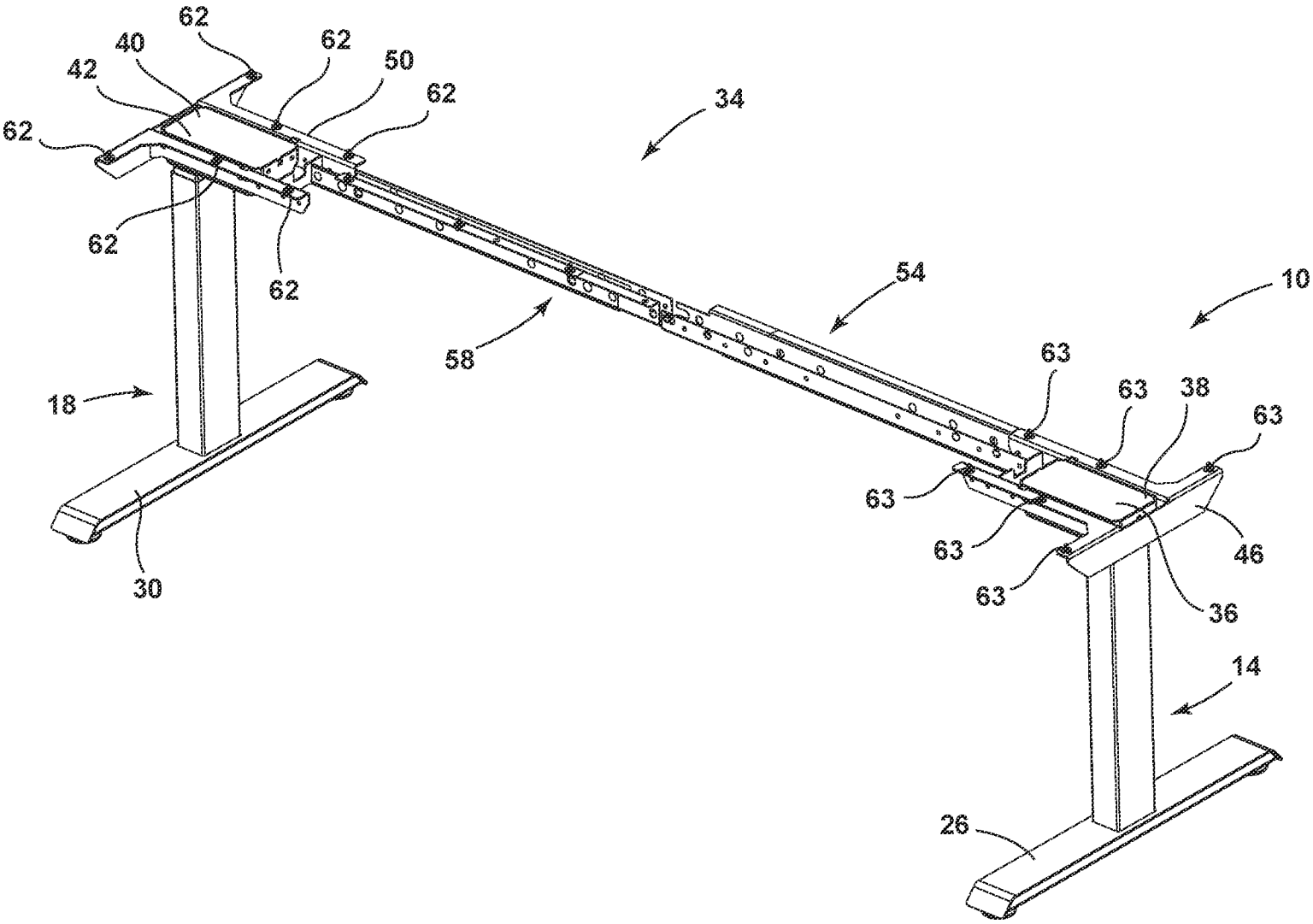
FIG. 2 is a perspective view of a first leg, a second leg, and a channel assembly for use with the table of FIG. 1.

FIG. 2 illustrates the table 10 with the worksurface 22 removed. The table 10 includes a channel assembly 34. The channel assembly 34 is positioned beneath the worksurface 22 and extends between the first leg 14 and the second leg 18. The channel assembly 34 is adjustable to fit different sizes (e.g., widths) of worksurfaces. For instance, the channel assembly 34 is adjustable to fit worksurfaces ranging from 42 to 62 inches. The channel assembly 34 is also configured to reduce worksurface sag.

The illustrated channel assembly 34 includes a first hub 38, a second hub 42, a first support bracket 46, a second support bracket 50, an outer channel 54, and an inner channel 58. The first hub 38 is positioned at an upper end of the first leg 14 within the first support bracket 46. The first hub 38 may include a motor or other suitable actuator that is operable to adjust a height of the first leg 14. The second hub 42 is positioned at an upper end of the second leg 18 within the second support bracket 50. The second hub 42 may include a motor or other suitable actuator that is operable to adjust a height of the second leg 18. In some embodiments, the table 10 may be fixed height table (i.e., non-height adjustable), and the motors and/or hubs may be omitted. The first support bracket 46 is mounted to the upper end of the first leg 14. The first support bracket 46 is configured to be coupled to an underside of the worksurface 22 to secure the first leg 14 to the worksurface 22. For example, fasteners 63 (e.g., screws, etc.) may couple the first support bracket 46 to the worksurface 22. The second support bracket 50 is mounted to the upper end of the second leg 18. The second support bracket 50 is configured to be coupled to the underside of the worksurface 22 to secure the second leg 18 to the worksurface 22. For example, fasteners 62 (e.g., screws, etc.) may couple the second support bracket 50 to the worksurface 22.

Figure 13:
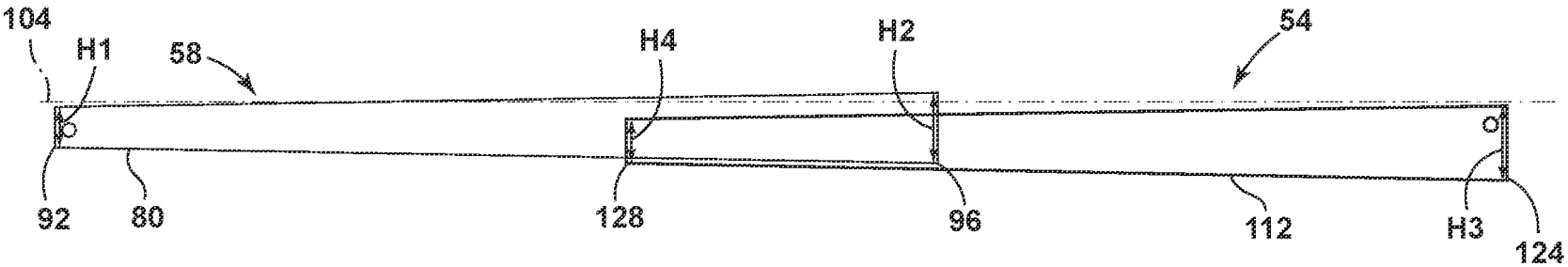
FIG. 13 schematically illustrates the inner channel and the outer channel in a second, extended configuration.

The channel assembly 34 is adjustable to accommodate different worksurface sizes (e.g., widths). In particular, the outer channel 54 and the inner channel 58 are movable (e.g., slidable) relative to each other depending on a distance between the first leg 14 and the second leg 18. The channel assembly 34 is configured to reduce worksurface sag by increasing a support height of the inner channel 58 for wider worksurfaces. Generally, wider worksurfaces will experience greater sag toward the middles of the worksurfaces (i.e., away from the legs 14, 18) compared to narrower worksurfaces. In the illustrated embodiment, the outer and inner channels 54, 58 are tapered to counteract the sag. For example, the inner channel 58 rests on top of the outer channel 54 such that as the channels 54, 54 are moved apart from each other, the inner channel 58 is forced upward (FIG. 13). This geometry results in the inner channel 58 pushing up the middle of the worksurface 22, based on the width of the channel assembly 34. In a widest setting or configuration, the inner channel 58 is forced the greatest distance upward and toward the worksurface 22 to counteract sag. In a shortest setting or configuration, the inner channel 58 is not forced upward or is only forced upward a minimal amount.

Figure 3:
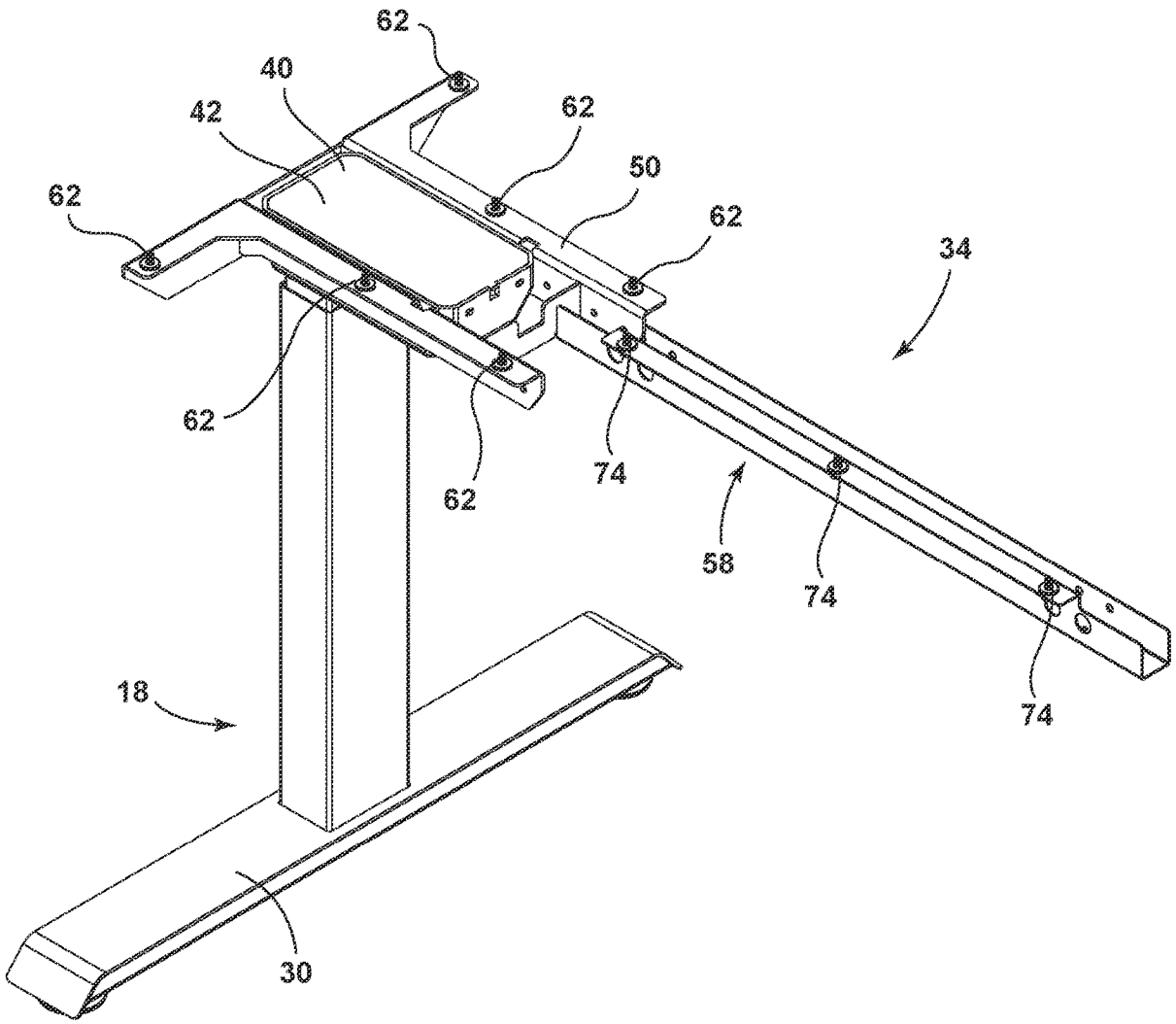
FIG. 3 is a perspective view of a portion of the channel assembly extending from the second leg.
Figure 4:
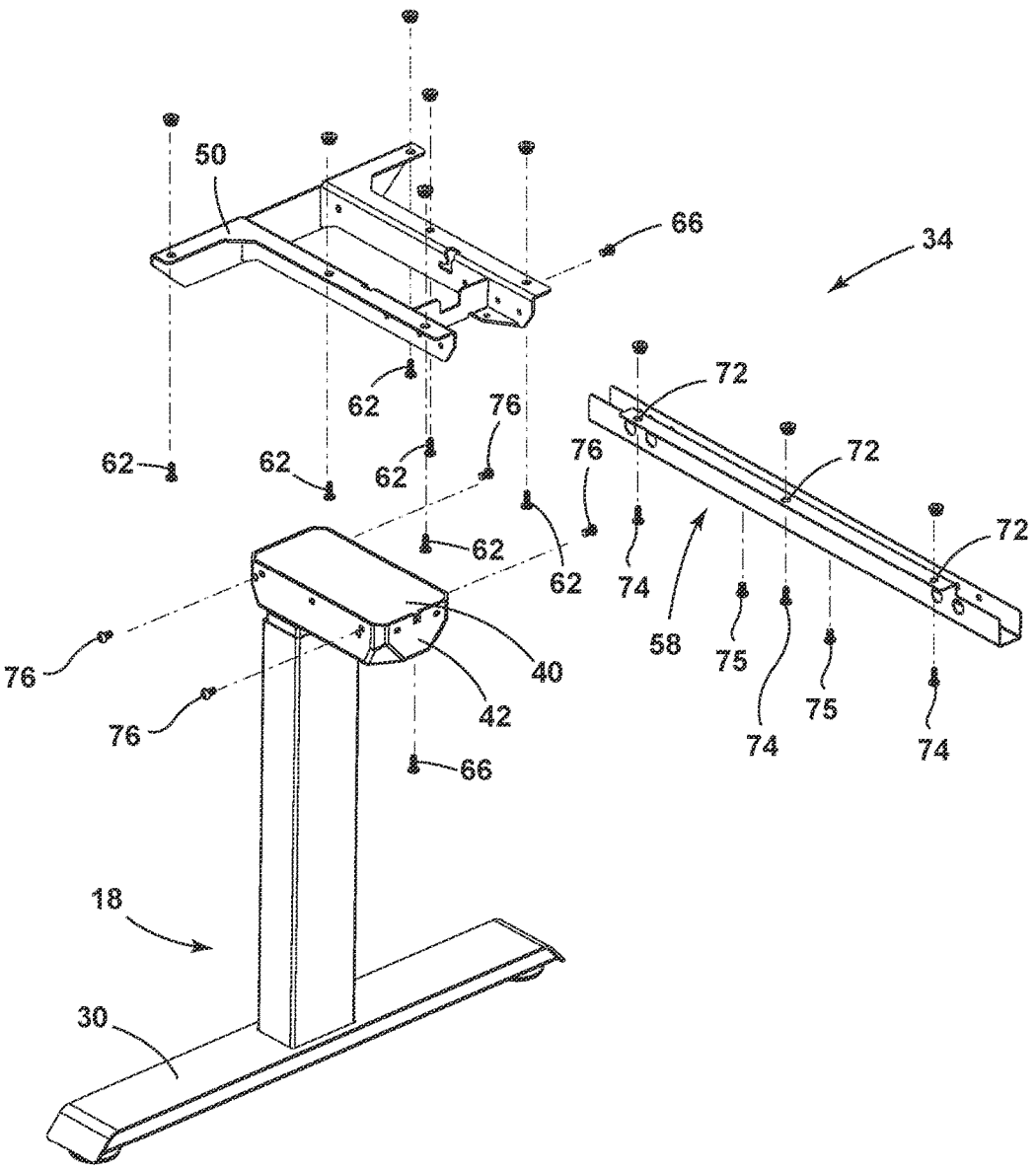
FIG. 4 is an exploded view of the portion of the channel assembly and the second leg of FIG. 3.
Figure 5:
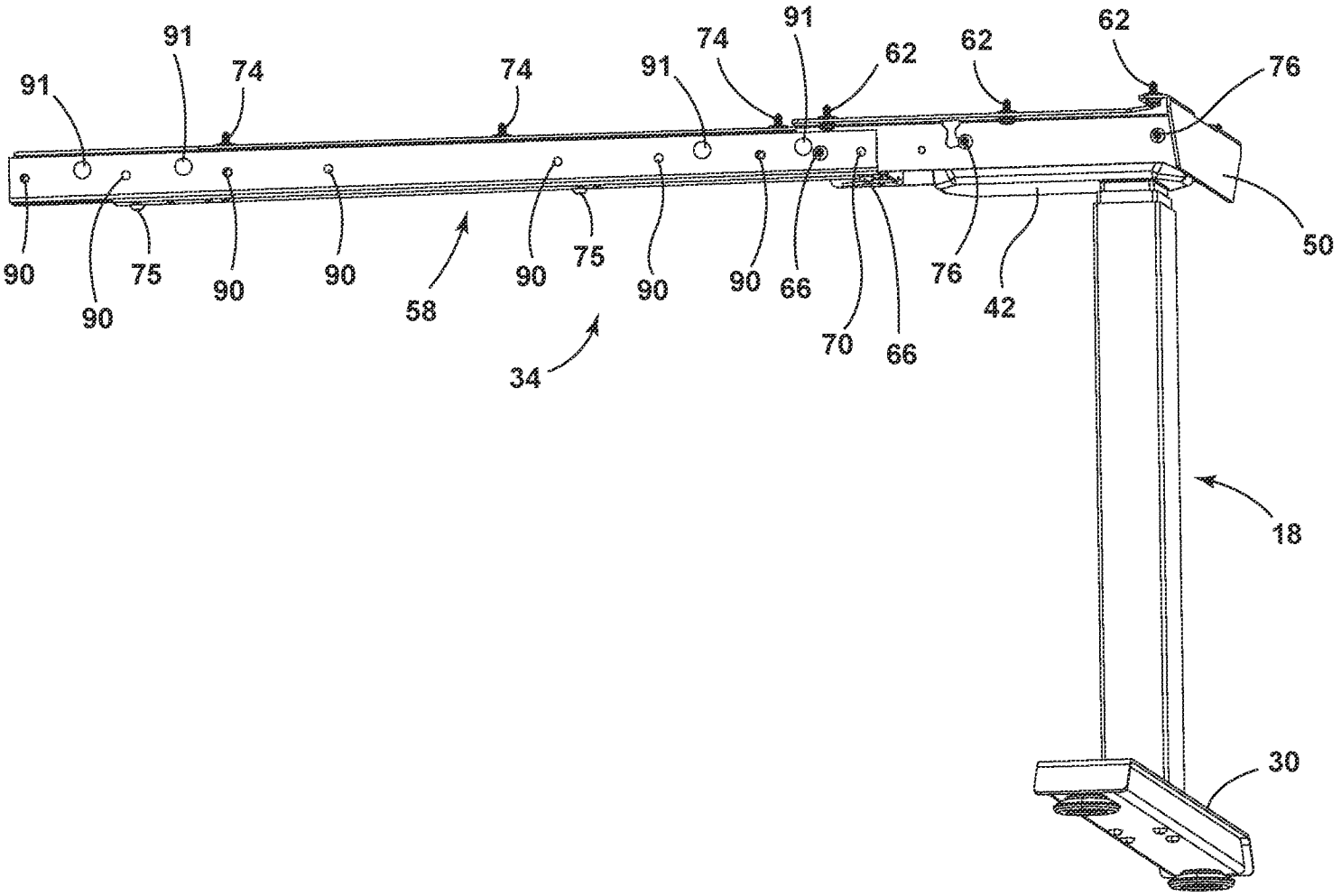
FIG. 5 is a bottom perspective view of the portion of the channel assembly and the second leg of FIG. 3.

FIGS. 3-5 illustrate a first portion of the channel assembly 34 extending from the second leg 18. The first portion of the channel assembly 34 includes the second hub 42, the second support bracket 50, and the inner channel 58. The inner channel 58 may also be referred to as a second channel or upper channel. The inner channel 58 is coupled to the second support bracket 50 by one or more fasteners 66 (FIG. 4) received through apertures 70 in the inner channel 58. The inner channel 58 also defines apertures 72 to receive fasteners 74 that couple the inner channel 58 to the worksurface 22. Fasteners 75 can couple the inner channel 58 and the outer channel 54 together. The second support bracket 50 is coupled to the second hub 42 by fasteners 76.

Figure 6:
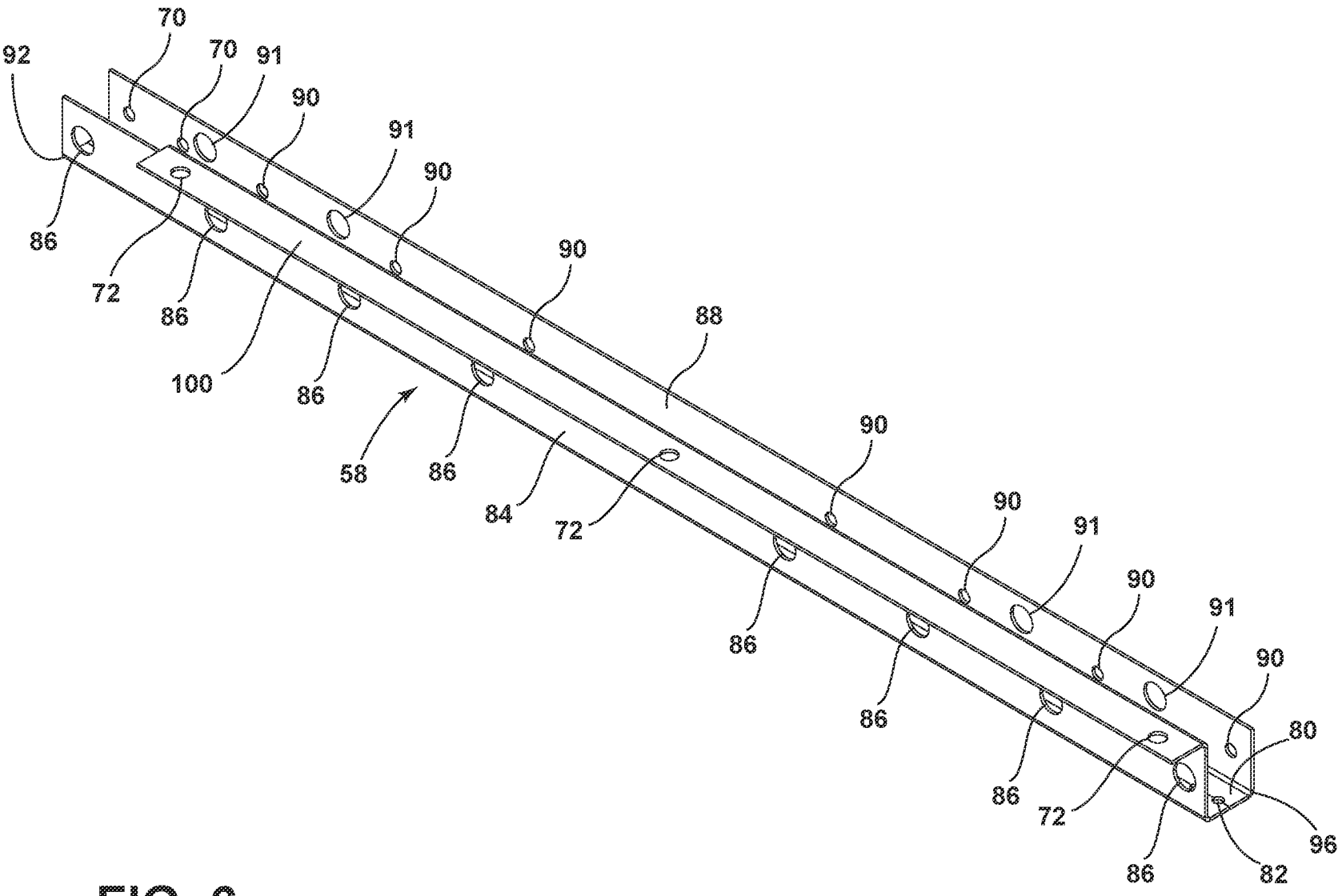
FIG. 6 is a top perspective view of an inner channel of the channel assembly.
Figure 7:
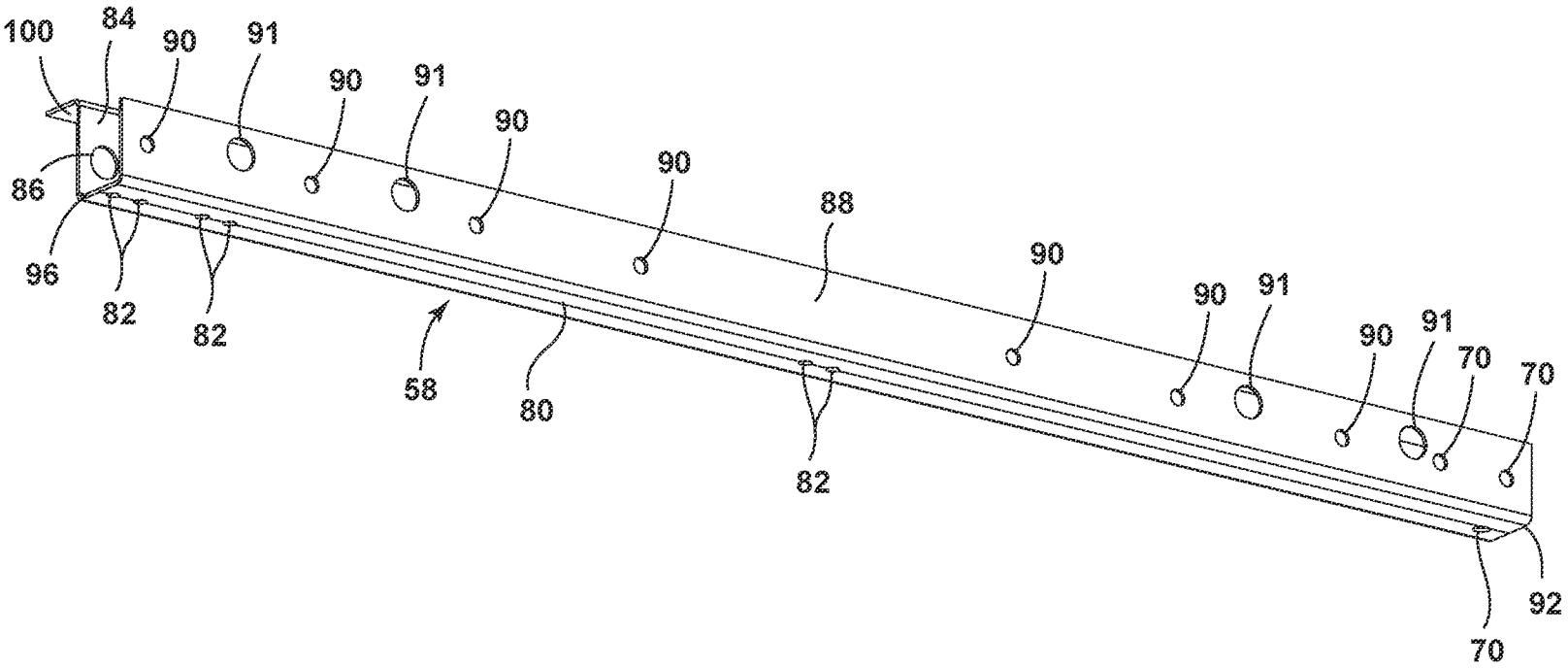
FIG. 7 is a bottom perspective view of the inner channel of the channel assembly.
Figure 8:
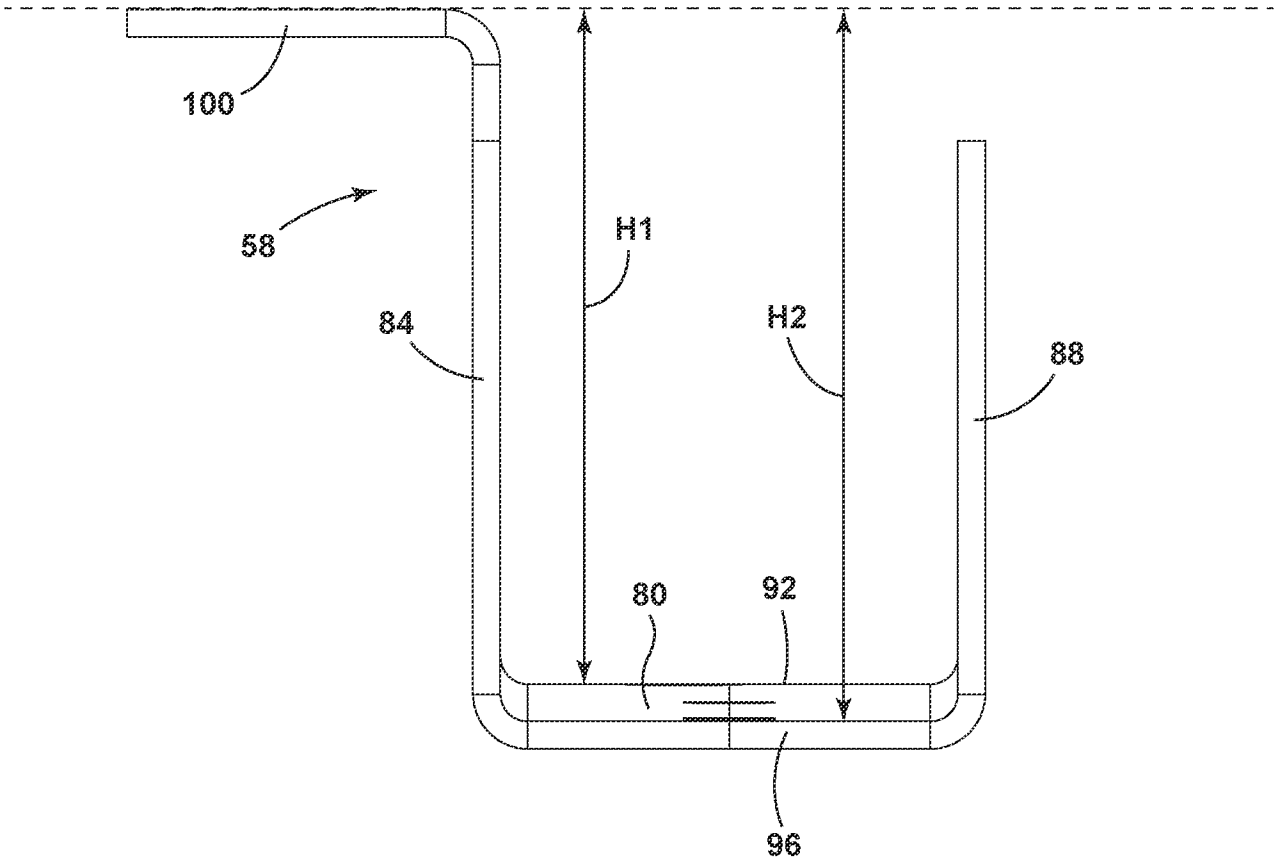
FIG. 8 is an end view of the inner channel of the channel assembly.

With reference to FIGS. 6-8, the illustrated inner channel 58 includes a bottom wall 80, a first sidewall 84, a second sidewall 88, and a flange 100. In the illustrated embodiment, the bottom wall 80, the first sidewall 84, the second sidewall 88, and the flange 100 are integrally formed as a single piece. For example, the bottom wall 80, the first sidewall 84, the second sidewall 88, and the flange 100 may be formed from a bent piece of sheet metal or as an extruded rail. In other embodiments, the bottom wall 80, the first sidewall 84, the second sidewall 88, and/or the flange 100 may be separate pieces that are secured together. The bottom wall 80 extends between the first and second sidewalls 84, 88. The bottom wall 80 defines at least one of the apertures 70 for connecting the inner channel 58 to the second support bracket 50. The bottom wall 80 also defines inner apertures 82 that the fasteners 75 extend through to couple the inner channel 58 and the outer channel 54 together. The first sidewall 84 extends perpendicularly (e.g., vertically) from a first edge of the bottom wall 80. The second sidewall 88 extends perpendicularly (e.g., vertically) from a second edge of the bottom wall 80. Together, the first sidewall 84, the bottom wall 80, and the second sidewall 88 give the inner channel 58 a generally U-shaped profile when viewed from an end (as shown in FIG. 8). The first sidewall 84 includes a plurality of apertures 86, and the second sidewall 88 includes a plurality of apertures 90, 91. The flange 100 extends perpendicularly (e.g., horizontally) from an upper edge the first sidewall 84 opposite the bottom wall 80. The flange 100 is generally parallel to, yet offset from, the bottom wall 80. The flange 100 provides a relatively flat and planar surface for the inner channel 58 to engage the underside of the worksurface 22. The flange 100 also defines the apertures 72.

The inner channel 58 also has two ends (e.g., a third end 92 and a fourth end 96). The third end 92 is configured to be coupled to the second support bracket 50. The fourth end 96 is configured to be received in the outer channel 54. The inner channel 58 increases in height from the third end 92 to the fourth end 96. In particular, the inner channel 58 has a first height H1 at the third end 92 and a second height H2 at the fourth end 96. The heights H1, H2 are measured as a distance between the bottom wall 80 and the flange (or as a height of each sidewall 84, 88). The second height H2 is greater than the first height H1 (or the first height H1 is less than the second height H2). For example, the second height H2 may be between 0.05 inches and 0.1 inches greater than the first height H1. In some embodiments, the second height H2 may be between 0.02 inches and 0.1 inches greater than the first height H1. In some embodiments, the second height H2 may be about 0.08 inches greater than the first height H1. In the illustrated embodiment, the height of the inner channel 58 continuously increases from the third end 92 to the fourth end 96. In addition, the height of the inner channel 58 gradually increases from the third end 92 to the fourth end 96. As such, the inner channel 58 tapers from the third end 92 to the fourth end 96. In other embodiments, the height of the inner channel 58 may increase along only a portion of the inner channel 58. Additionally or alternatively, the height of the inner channel 58 may change abruptly along its length or in particular areas.

Figure 9:
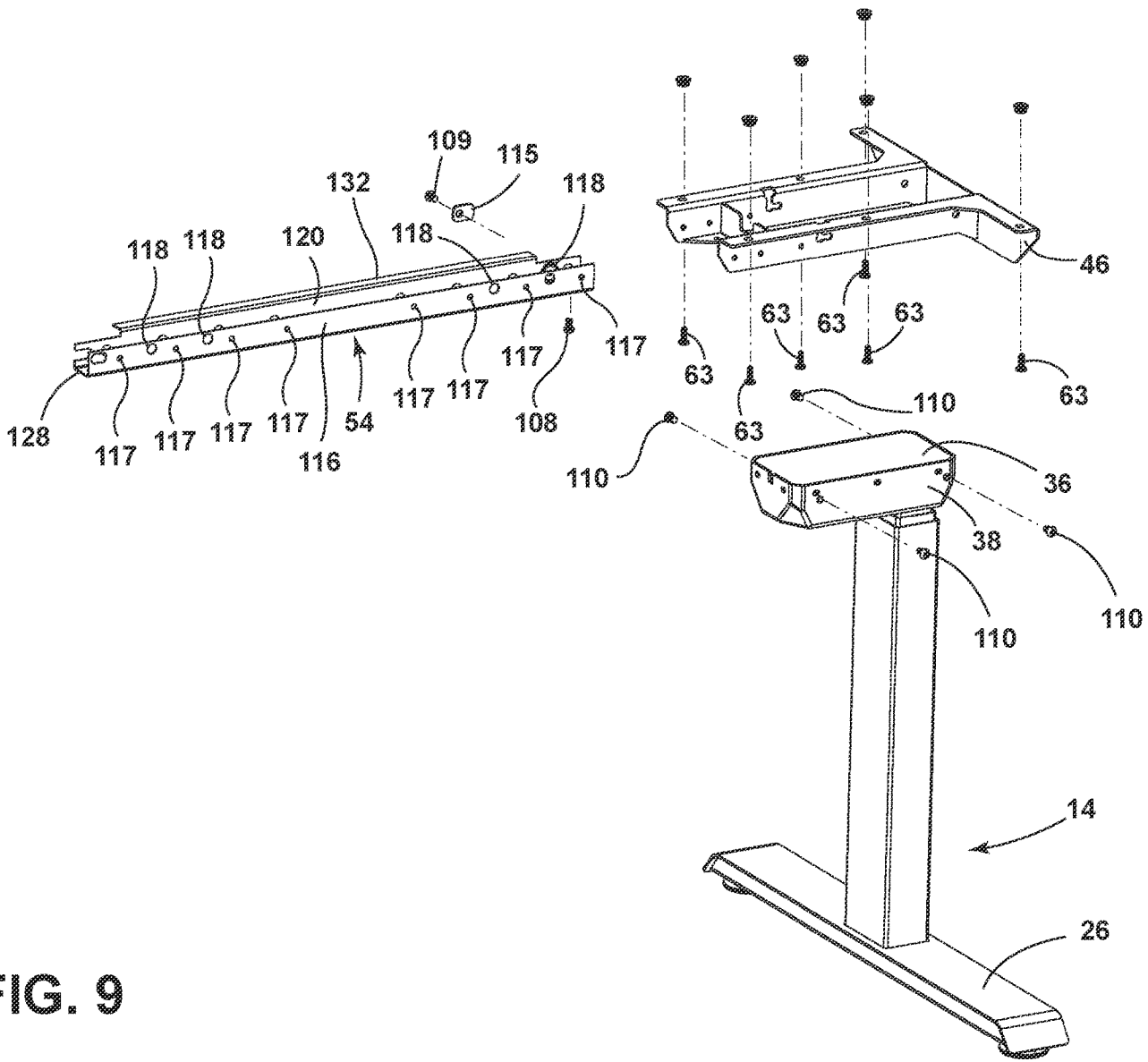
FIG. 9 an exploded view of another portion of the channel assembly and the first leg.

FIG. 9 illustrates a second portion of the channel assembly 34 extending from the first leg 14. The second portion of the channel assembly 34 includes the first hub 38, the first support bracket 46, and the outer channel 54. The outer channel 54 may also be referred to as a first channel or lower channel. The outer channel 54 is coupled to the first support bracket 46 by fasteners 108, 109 received through apertures 113, 121 in the outer channel 54. The fastener 109 couples to a washer 115. The first support bracket 46 is coupled to the first hub 38 by fasteners 110. Unlike the inner channel 58, the outer channel 54 does not define apertures that receive fasteners to coupled the outer channel 54 to the worksurface 22. As such, the outer channel 54 is not directly coupled to the worksurface 22.

Figure 10:
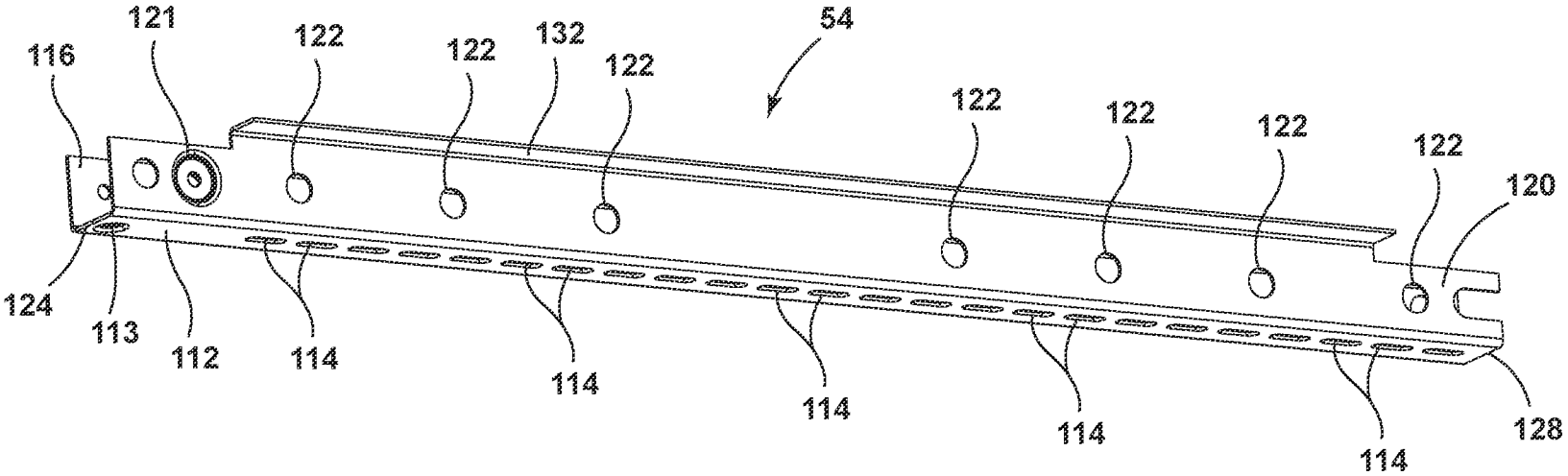
FIG. 10 is a bottom perspective view of an outer channel of the channel assembly.
Figure 11:
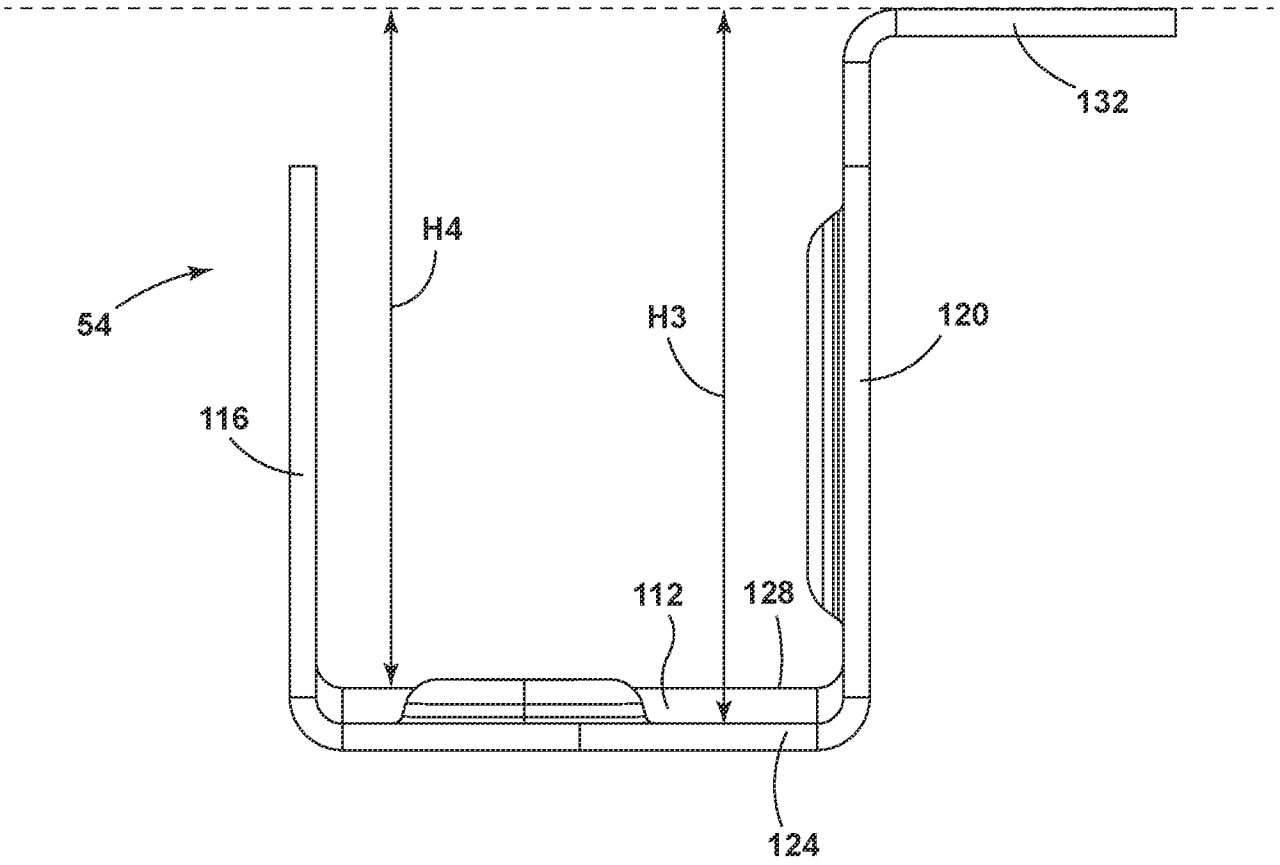
FIG. 11 is an end view of the outer channel of the channel assembly.

With reference to FIGS. 9-11, the illustrated outer channel 54 includes a bottom wall 112, a first sidewall 116, a second sidewall 120, and a flange 132. In the illustrated embodiment, the bottom wall 112, the first sidewall 116, the second sidewall 120, and the flange 132 are integrally formed as a single piece. For example, the bottom wall 112, the first sidewall 116, the second sidewall 120, and the flange 132 may be formed from a bent piece of sheet metal or as an extruded rail. In other embodiments, the bottom wall 112, the first sidewall 116, the second sidewall 120, and/or the flange 132 may be separate pieces that are secured together. The bottom wall 112 extends between the first and second sidewalls 116, 120. The bottom wall 112 defines the aperture 113 for connecting the outer channel 54 to the first support bracket 46. The bottom wall 112 also defines outer apertures 114 configured to receive one of the fasteners 75 used to couple the inner channel 58 and the outer channel 54 together. In the illustrated embodiment, the outer apertures 114 are elongated slots. The first sidewall 116 extends perpendicularly (e.g., vertically) from a first edge of the bottom wall 112. The second sidewall 120 extends perpendicularly (e.g., vertically) from a second edge of the bottom wall 112. Together, the first sidewall 116, the bottom wall 112, and the second sidewall 120 give the outer channel 54 a generally U-shaped profile when viewed from an end (as shown in FIG. 11). The first sidewall 116 includes apertures 117 and apertures 118. The second sidewall 120 includes the aperture 121 and apertures 122. The aperture 121 is configured to receive one of the fasteners 75 used to couple the inner channel 58 and the outer channel 54 together. The flange 132 extends perpendicularly (e.g., horizontally) from an upper edge the first sidewall 116 opposite the bottom wall 112. The flange 132 is generally parallel to, yet offset from, the bottom wall 112.

The outer channel 54 also has two ends (e.g., a first end 124 and a second end 128). The first end 124 is configured to be coupled to the first support bracket 46. The second end 128 is configured to overlap the inner channel 58. The outer channel 54 decreases in height from the first end 124 to the second end 128. In particular, the outer channel 54 has a first height H3 at the first end 124 and a second height H4 at the second end 128. The heights H3, H4 are measured as a distance between the bottom wall 112 and the flange 132 (or as a height of each sidewall 116, 120). The first height H3 is greater than the second height H4 (or the second height H4 is less than the first height H3). For example, the first height H3 may be between 0.05 inches and 0.1 inches greater than the second height H4. In some embodiments, the first height H3 may be about 0.08 inches greater than the second height H4. As such, the change in heights of the outer channel 54 may be generally the same as the change in heights of the inner channel 58. In other words, the change in height from the first end 124 to the second end 128 of the outer channel 54 is equivalent to the change in height of the fourth end 96 to the third end 92 of the inner channel 58. In other embodiments, the change in heights of the two channels 54, 58 may be different, or only one of the channels 54, 58 may have a change in height. In the illustrated embodiment, the height of the outer channel 54 continuously decreases from the first end 124 to the second end 128. In addition, the height of the outer channel 54 gradually decreases from the first end 124 to the second end 128. As such, the outer channel 54 tapers from the first end 124 to the second end 128. In other embodiments, the height of the inner channel 58 may decrease along only a portion of the inner channel 58. Additionally or alternatively, the height of the outer channel 54 may change abruptly along its length or in particular areas.

In an assembled state, the inner channel 58 and the outer channel 54 are coupled together by the fasteners 75 extending through the outer apertures 114 of the outer channel 54 and through the inner apertures 82 of the inner channel 58. The inner channel 58 is supported by the bottom wall 112 of the outer channel 54 and is coupled to the worksurface 22 by the fasteners 74. For example, the bottom wall 80 of the inner channel 58 rests on the bottom wall 112 of the outer channel 54. The worksurface 22 is additionally supported by the top surfaces 36, 40 of the hubs 38, 42 and coupled to the support brackets 46, 50 by the fasteners 63, 62.

Figure 12:
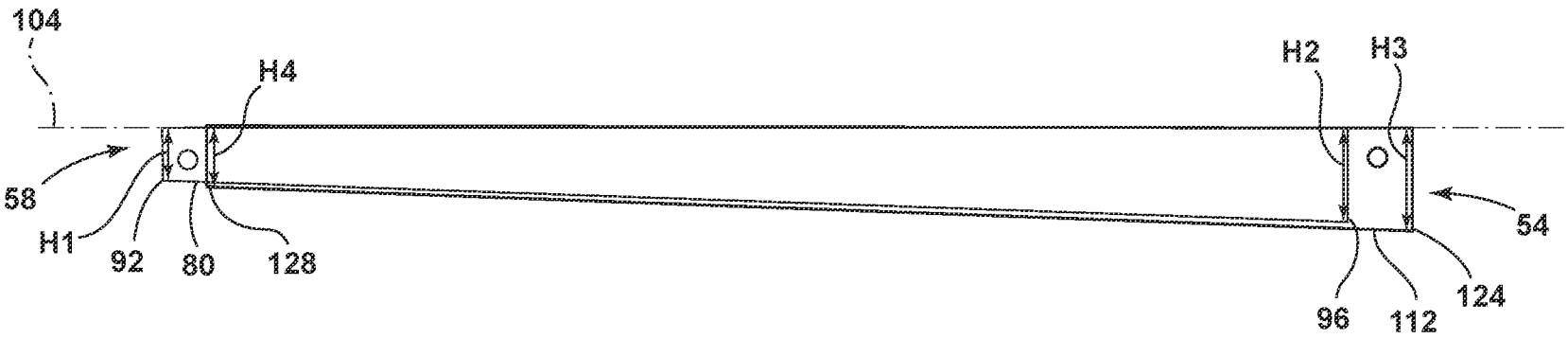
FIG. 12 schematically illustrates the inner channel and the outer channel in a first, collapsed configuration.

FIG. 12 illustrates the inner channel 58 and outer channel 54 in a first configuration. In this configuration, the channels 54, 58 are in a collapsed position or a shortest width setting relative to each other. The shortest width setting may be used to support a worksurface with a width of, for example, approximately 44 inches. In the first configuration, the fourth end 96 of the inner channel 58 is adjacent the first end 124 of the outer channel 54 and the second end 128 of the outer channel 54 is adjacent the third end 92 of the inner channel 58 such that a distance between the first end 124 and the third end 92 is at its shortest. As mentioned above, the inner and outer channels 58, 54 have larger heights H2, H3 at the fourth end 96 and the first end 124. Since the fourth end 96 is adjacent the first end 124, the inner channel 58 is not forced upwardly by the outer channel 54. Rather, upper edges (and, particularly, the flanges 100, 132) of the channels 54, 58 are generally parallel and coplanar with each other to engage the underside of the worksurface 22, represented by a hypothetical plane 104.

FIG. 13 shows the inner channel 58 and outer channel 54 in a second configuration. In this configuration, the channels 54, 58 are in an extended position or a larger width setting relative to each other. The larger width setting may be used to support a worksurface with a width of, for example, approximately 62 inches. In the second configuration, the fourth end 96 of the inner channel 58 is adjacent the second end 128 of the outer channel 54 such that a distance between the first end 124 and the third end 92 is larger than when in the first configuration. Due to the taper of the channels 54, 58, the inner channel 58 is forced upwardly by the outer channel 54 relative to the hypothetical plane 104. As such, the inner channel 58 pushes upwardly on the underside of the worksurface 22 to counteract and reduce sag near the middle of the worksurface 22. For example, in the illustrated configuration, the upper edge (e.g., the flange 100) of the inner channel 58 may be raised between approximately 0.05 inches and 0.1 inches above the upper edge (e.g., the flange 132) of the outer channel 54.

The channel assembly 34 may support a wide variety of widths between the shortest and widest setting. For instance, the channel assembly 34 can support a worksurface having a width of 50 inches, 56 inches, and the like. Due to the taper of the channels 54, 58, the distance that the upper edge the inner channel 58 is raised also varies. For instance, when used with a 50-inch worksurface, the distance may be approximately 0.026 inches. When used with a 56-inch worksurface, the distance may be approximately 0.052 inches.

To assemble the table 10, a user identifies a width of the worksurface 22. The user then moves (e.g., slides) the outer and inner channels 54, 58 relative to each other match the desired width. The width of the channel assembly 34 is fixed by the fasteners 75 extending through the channels 54, 58. In some embodiments, the channels 54, 58 may be connected to the legs 14, 18 (e.g., via the support brackets 46, 50) before or after the desired width is set. The channels 54, 58, along with the support brackets 46, 50 and the legs 14, 18, are then secured to the underside of the worksurface 22 via the fasteners 74.

Although the illustrated channel assembly 34 includes one outer channel 54 and one inner channel 58, in some embodiments, the channel assembly 34 may include two or more outer channels 54 and two or more inner channels 58. In such embodiments, each outer channel 54 may be matched with a corresponding inner channel 58 to create a channel set. The channel sets may be arranged in parallel on the underside of the worksurface 22. In addition, each channel set may be coupled to the support brackets 46, 50.

Figure 14:
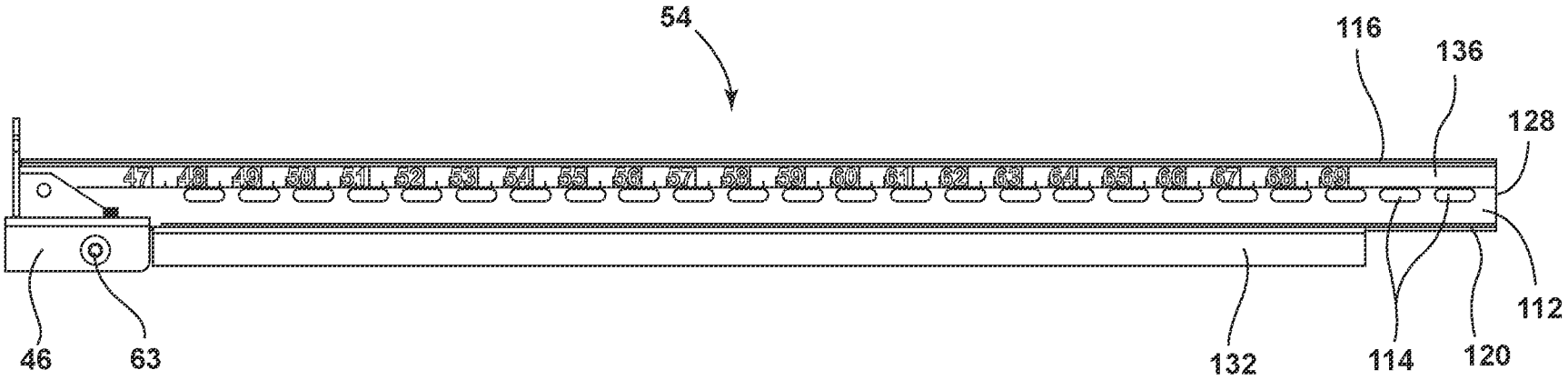
FIG. 14 is a top view of the outer channel with a ruler.

As shown in FIG. 14, in some embodiments, the channel assembly 34 may include a ruler 136. The ruler 136 includes a plurality of indicators corresponding to widths of different worksurfaces. The ruler 136 may be permanently or removably coupled to one of the channels 54, 58. For example, the ruler 136 may be printed, etched, engraved, embossed, and the like on one of the channels 54, 58. Alternatively, the ruler 136 may be a sticker or other label that is adhered to one of the channels 54, 58. In the illustrated embodiment, the ruler 136 is on the bottom wall 112 of the outer channel 54. Since the fourth end 96 of the of the inner channel 58 rests on the bottom wall 112 of the outer channel 54, the indicators are covered up by the inner channel 58. As the fourth end 96 of the inner channel 58 moves toward the second end 128 of the outer channel 54, the indicators of the ruler may be "revealed." In alternate embodiments, the ruler 136 is visible to a user when the table 10 is upside-down and being assembled. In other embodiments, the ruler 136 may be located on another side of the outer channel 54, such as one of the sidewalls 116, 120. In alternate embodiments, the ruler 136 can be located on the bottom wall 80 of the inner channel 58. The indicators of the ruler 136 may be "revealed" as inner channel 58 slides out of the outer channel 54.

Figure 15:
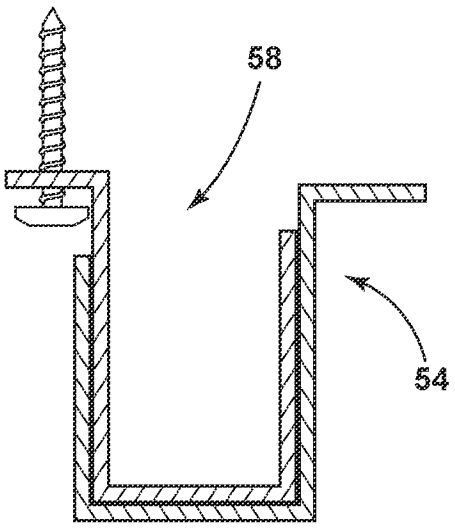

FIGS. 15-18 illustrate various possible configurations (e.g., shapes) of the inner channel 58 and the outer channel 54. Referring to FIG. 15, the inner channel 58 and outer channel 54 are both U-shaped channels, as described above.

Figure 16:
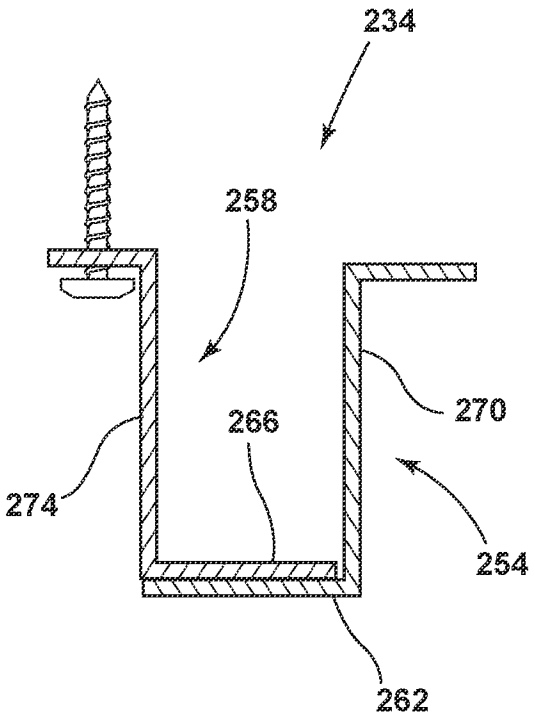
FIGS. 15-18 include end views illustrating alternate constructions of the inner channel and the outer channel.

FIG. 16 illustrates an alternate embodiment of a channel assembly 234 including an inner channel 258 and an outer channel 254. Each channel 254, 258 includes a bottom wall 262, 266, but only one sidewall 270, 274. As such, in this configuration, the inner channel 258 and the outer channel 254 are both Z-shaped channels.

Figure 17:
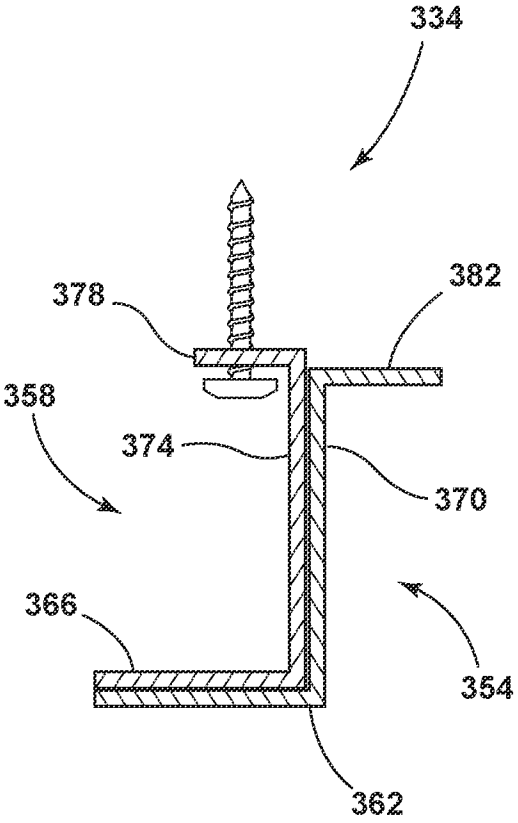

FIG. 17 illustrates an alternate embodiment of a channel assembly 334 including an inner channel 358 and an outer channel 354. Similar to the channel assembly 234, each channel 354, 358 includes a bottom wall 362, 366, but only one sidewall 370, 374. In the illustrated embodiment, the sidewalls 370, 374 directly overlap each other. As such, a flange 378 of the inner channel 358 extends inwardly relative to the channel assembly 334, while a flange 382 of the outer channel 354 extends outwardly relative to the channel assembly 334.

Figure 18:
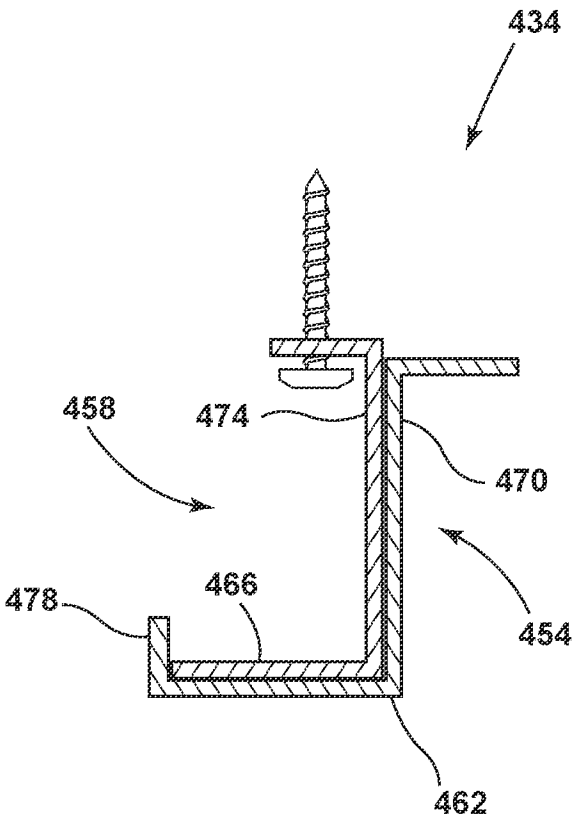

FIG. 18 illustrates an alternate embodiment of a channel assembly 434 including an inner channel 458 and an outer channel 454. The illustrated channel assembly 434 is similar to the channel assembly 334. For example, each channel 454, 458 includes a bottom wall 462, 466 and one sidewall 470, 474. However, in the illustrated embodiment, the outer channel 454 also includes a second, partial sidewall 478 to help maintain the inner channel 454 within the outer channel 454.

Various features and advantages of the invention are set forth in the following claims.

What is claimed is:

1. A channel assembly configured to support a worksurface, the channel assembly comprising:

an outer channel having a first end and a second end opposite the first end, the outer channel decreasing in height from the first end to the second end; and an inner channel configured to be connected to the worksurface, the inner channel having a third end and a fourth end opposite the third end, the inner channel increasing in height from the third end to the fourth end, the inner channel at least partially received in the outer channel such that the fourth end is positioned within the outer channel and the second end overlaps the inner channel, wherein the inner channel is movable relative to the outer channel to adjust a width between the first end and the third end, wherein in response to the inner channel being moved apart from the outer channel, the fourth end of the inner channel is moved away from the first end and toward the second end of the outer channel and an upper edge of the inner channel is raised relative to an upper edge of the outer channel to push upwardly on an underside of the worksurface.

2. The channel assembly of claim 1, wherein the height of the outer channel gradually decreases from the first end to the second end.

3. The channel assembly of claim 1, wherein the height of the inner channel gradually increases from the third end to the fourth end.

4. The channel assembly of claim 1, wherein the inner channel defines an aperture, and wherein the inner channel is coupled to the worksurface via a fastener extending through the aperture.

5. The channel assembly of claim 1, wherein the inner channel and the outer channel are both U-shaped channels.

6. The channel assembly of claim 1, wherein the inner channel includes a bottom wall and a sidewall extending from the bottom wall, wherein the outer channel includes a bottom wall and a sidewall extending from the bottom wall, and wherein the bottom wall of the inner channel rests on the bottom wall of the outer channel.

7. The channel assembly of claim 6, wherein the inner channel also includes a flange extending from the sidewall of the inner channel, and wherein the flange is configured to couple the inner channel to the worksurface.

8. The channel assembly of claim 7, wherein the sidewall of the inner channel extends perpendicularly from the bottom wall of the inner channel, and wherein the flange of the inner channel extends perpendicularly from the sidewall of the inner channel.

9. The channel assembly of claim 1, wherein a height of the outer channel at the first end is between 0.05 inches and 0.1 inches greater than a height of the outer channel at the second end, and wherein a height of the inner channel at the fourth end is between 0.05 inches and 0.1 inches greater than a height of the inner channel at the third end.

10. The channel assembly of claim 1, further comprising a ruler having a plurality of indicators corresponding to widths of different worksurfaces.

11. The channel assembly of claim 10, wherein the ruler is coupled to a bottom wall of the outer channel.

12. A table comprising:
a worksurface;
a first leg coupled to the worksurface;
a second leg coupled to the worksurface; and
a channel assembly positioned beneath the worksurface, the channel assembly including
an outer channel having a first end coupled to the first leg and a second end opposite the first end, the outer channel decreasing in height from the first end to the second end, and
an inner channel connected to the worksurface, the inner channel having a third end coupled to the second leg and a fourth end opposite the third end, the inner channel increasing in height from the third end to the fourth end, the inner channel at least partially received in the outer channel such that the fourth end is positioned within the outer channel and the second end overlaps the inner channel,
wherein the inner channel is movable relative to the outer channel to adjust a width between the first end and the third end,
wherein in response the inner channel being moved apart from the outer channel, the fourth end of the inner channel is moved away from the first end and toward the second end of the outer channel and an upper edge of the inner channel is raised relative to an upper edge of the outer channel to push upwardly on an underside of the worksurface.

13. The table of claim 12, wherein the outer channel is not directly coupled to the worksurface.

14. The table of claim 12, wherein the height of the outer channel gradually decreases from the first end to the second end, and wherein the height of the inner channel gradually increases from the third end to the fourth end.

15. The table of claim 12, wherein the inner channel includes a bottom wall and a sidewall extending from the bottom wall, wherein the outer channel includes a bottom wall and a sidewall extending from the bottom wall, and wherein the bottom wall of the inner channel rests on the bottom wall of the outer channel.

16. The table of claim 15, wherein the inner channel also includes a flange extending from the sidewall of the inner channel, and wherein the flange is configured to couple the inner channel to the worksurface.

17. The table of claim 16, wherein the sidewall of the inner channel extends perpendicularly from the bottom wall of the inner channel, and wherein the flange of the inner channel extends perpendicularly from the sidewall of the inner channel.

18. The table of claim 12, wherein a height of the outer channel at the first end is between 0.05 inches and 0.1 inches greater than a height of the outer channel at the second end, and wherein a height of the inner channel at the fourth end is between 0.05 inches and 0.1 inches greater than a height of the inner channel at the third end.

19. The table of claim 12, further comprising:
a first support bracket coupled to the worksurface and the first leg; and
a second support bracket coupled to the worksurface and the second leg,
wherein the outer channel is coupled to the first leg via the first support bracket and wherein the inner channel is coupled to the second leg via the second support bracket.

20. A table comprising:
a worksurface;
an outer channel having a first end and a second end opposite the first end, the first end having a first height, the second end having a second height that is less than the first height; and
an inner channel connected to the worksurface, the inner channel having a third end and a fourth end opposite the third end, the third end having a third height, the fourth end having a fourth height that is greater than the third height, the inner channel at least partially received in the outer channel such that the fourth end is positioned within the outer channel and the second end overlaps the inner channel,
wherein the inner channel is movable relative to the outer channel between a first configuration and a second configuration to adjust a width between the first end and the third end, wherein the fourth end of the inner channel is closer to the first end of the outer channel when the inner channel is in the first configuration than when the inner channel is in the second configuration, and wherein in the second configuration an upper edge of the inner channel is raised further relative to an upper edge of the outer channel to push upwardly on an underside of the worksurface than when in the first configuration.

* * * * *